United States Patent [19]

Mabuchi

[11] Patent Number: 4,481,939

[45] Date of Patent: Nov. 13, 1984

[54] BEAUTY TREATMENT DEVICE

[75] Inventor: Kenichi Mabuchi, Matsudo, Japan

[73] Assignee: Bio Mabuchi Co., Ltd., Japan

[21] Appl. No.: 337,653

[22] Filed: Jan. 7, 1982

[30] Foreign Application Priority Data

Jan. 16, 1981 [JP] Japan ..... 56-5648
Jan. 21, 1981 [JP] Japan ..... 56-7541

[51] Int. Cl.[3] ..... A61H 15/00
[52] U.S. Cl. ..... 128/57; 128/32
[58] Field of Search ..... 128/24.3, 32, 52, 57, 128/60, 59, 61; 46/221; 74/86; 366/108

[56] References Cited

U.S. PATENT DOCUMENTS

| | | | |
|---|---|---|---|
| 494,168 | 3/1893 | Robinson | 46/221 |
| 2,294,947 | 9/1942 | Andis | 128/60 X |
| 2,624,335 | 1/1953 | Miller | 128/57 X |
| 2,944,543 | 7/1960 | Newcombe | 128/57 X |
| 2,972,347 | 2/1961 | McNair | 128/57 X |
| 3,003,497 | 10/1961 | Nunes | 128/57 |
| 3,616,794 | 11/1971 | Gromala | 128/57 |
| 3,733,744 | 5/1973 | Hiltpold et al. | 46/221 X |
| 3,924,352 | 12/1975 | Goldfarb et al. | 46/221 |
| 4,412,535 | 11/1983 | Teren | 128/57 |

FOREIGN PATENT DOCUMENTS

| | | | |
|---|---|---|---|
| 66895 | of 1892 | Fed. Rep. of Germany | 128/57 |

*Primary Examiner*—Richard J. Apley
*Assistant Examiner*—David J. Brown
*Attorney, Agent, or Firm*—McGlew and Tuttle

[57] ABSTRACT

A beauty treatment device having sharp-edged disc-like wheels, a wheel shaft for supporting the wheels, a device body for rotatably supporting the wheel shaft, a weight, resting on the device body, for giving pushing force to the wheel shaft, a vibration generation mechanism for giving vibration to the wheel shaft, and a travelling mechanism for causing the wheel shaft to rotate is disclosed. The device provides massage by giving vibration to the wheel shaft and causing the wheel shaft to rotate on the axis thereof.

19 Claims, 37 Drawing Figures

BEAUTY TREATMENT DEVICE

BACKGROUND OF THE INVENTION

This invention relates generally to a beauty treatment device, and more particularly to a beauty treatment device for providing massage to the skin by causing sharp-edged disc-like wheels to sink into the skin surface by the weight of a device body and/or a weight while causing the wheel to travel on the skin surface.

DESCRIPTION OF THE PRIOR ART

It is generally known that the adipose tissue consists of the white adipose tissue and the brown one. The brown adipose tissue contains more mitochondria, which burn the adipose carried into the adipose tissue by cells, than the white one. It is also known that the brown adipose tissue having such a function is found more abundantly on the back of the human body, and that the location and area of the brown adipose tissue differ with individual persons.

Recent experimental results, which will be described later, indicate that the brown adipose tissue, when stimulated, actively burns excess adipose in the body to convert into heat.

In view of this function of the brown adipose tissue, various massagers have heretofore been used which massage the skin by linearly reciprocating the massaging element or giving circular motion to the element while forcing the element onto the skin. However, conventional massagers are mostly of the chair type, as often found in public bath houses, and the contact surface of the massaging element as used in such conventional massagers is of an essentially flat or spherical shape. Such a massaging element of a flat or spherical shape depresses the skin surface only slightly because of the relatively wider surface area thereof, making it difficult to cause the massaging force to penetrate deep into the skin surface. With such conventional massagers, therefore, it is necessary that the pushing force be increased so as to cause the massaging effect to penetrate deep into the muscular tissue beneath the skin surface.

As a means for overcoming this problem and giving stimuli to the aforementioned brown adipose tissue, a beauty treatment device has been proposed by the present inventor. In this beauty treatment device, a cylindrical massaging element consisting of an oscillating/pushing member and a connector is detachably connected at the connector to an oscillator via a connecting mechanism. The oscillator is supported by a fixing member by means of a resilient support member and at the same time fitted to an eccentric piece via a ball bearing. The eccentric piece has an eccentric shaft hole at an off-center position thereof. A motor shaft is fixedly inserted into the eccentric shaft hole. A motor is fitted to a body case via the fixing member. A handle is integrally provided on the body case. Massaging is effected by holding the handle to press the massaging element against the skin surface. That is, the skin surface is depressed by a peripheral part along the open end of the essentially cylindrical massaging element having a hollow part while vibration is given to the skin and the subcutaneous muscular tissue by the oscillating motion of the massaging element generated by the rotation of the motor. With this type of massager, however, a considerable effort is required to hold the handle to push the massaging element against the skin surface, giving considerable fatigue to the operator. In this respect, this type of massager is not suitable for massaging continuously for long hours.

SUMMARY OF THE INVENTION

It is an object of this invention to provide a beauty treatment device having sharp-edged disk-like wheels, a wheel shaft for supporting the wheels, a device body for rotatably supporting the wheel shaft, and a weight, resting on the device body, for giving pushing force, together with the device body, to the wheel shaft, which provides massage by causing the sharp edges of the wheel to press and sink into the skin surface by the weight of the device body and the weight resting thereon.

It is another object of this invention to provide a beauty treatment device for giving massage to the skin surface by means of a vibrating mechanism, provided in the device body thereof, for causing the wheels to vibrate by the centrifugal force generated as an eccentric cam, of a sector shape, for example, is rotated along the pivot thereof.

It is another object of this invention to provide a beauty treatment device for giving massage to the skin by causing the wheels to vibrate at a predetermined amplitude, without being affected by the weight applied to the wheels, by means of a vibrating mechanism which causes the wheels themselves to make an orbital motion along a predetermined circular orbit.

It is still another object of this invention to provide a beauty treatment device for giving massage to the skin surface, having a travelling mechanism for causing the device to automatically travel on any desired portion of the skin surface by causing the wheel shaft to revolve on the axis thereof by means of a drive unit, for example, built in the device body.

It is a further object of this invention to provide a beauty treatment device for giving massage to the skin surface wherein the ends of the wheel shaft are adapted to provide interchangeability to wheels so as to install wheels having edges of appropriate sharpness to generate desired pushing force.

It is a further object of this invention to provide a beauty treatment device wherein tires made of a resilient material are detachably provided on the outer periphery of the wheels so to give edges of desired sharpness to the wheels and to make the tires interchangeable.

It is a further object of this invention to provide a beauty treatment device wherein the pushing force of the wheels onto the skin surface is made easily adjustable by making the weight, which is placed on the weight mount of the device body, detachable by providing magnetic poles of different polarities at opposing positions of the weight and the weight mount, whereby making the weight easily changeable with that of a proper weight.

It is a further object of this invention to provide a beauty treatment device wherein the bottom surface of the device opposing the skin surface is formed into a V-shape, and the entire device assembly is formed substantially in an inverted triangle, with the center axis of the wheel as the apex thereof, so that the operator can easily control the pushing force onto the skin surface in accordance with the thickness of the muscular tissue beneath the skin surface simply by raising and lowering the handle with respect to the skin surface, that is, tilting the device body around the drive shaft of the wheels.

These and other objects and advantages of the invention will become more apparent from the following description taken in connection with the accompanying drawings.

BRIEF DESCRIPTION OF THE DRAWINGS

FIG. 17 (B) is a crosssection of the wheel of FIG. 17 (A).

FIG. 18 (B) is a partial perspective view illustrating the crosssectional shape of the embodiment shown in FIG. 18 (A).

FIG. 19 (B) is a crosssection of the wheel portion of the seventh embodiment of this invention.

FIG. 20 (B) is a partially enlarged perspective view illustrating the crosssectional shape of the seventh embodiment shown in FIG. 20 (A).

DETAILED DESCRIPTION OF THE EMBODIMENT

Figure 1:
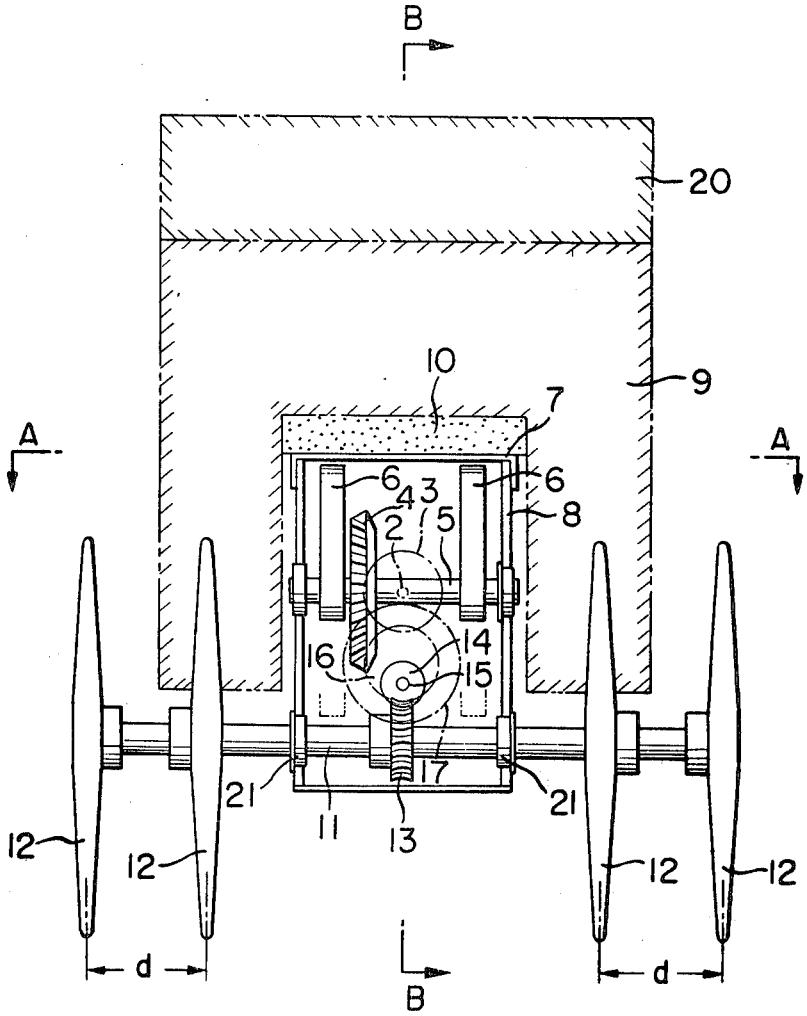
FIG. 1 is a transverse crosssection illustrating the construction of a first beauty treatment device embodying this invention.
Figure 2:
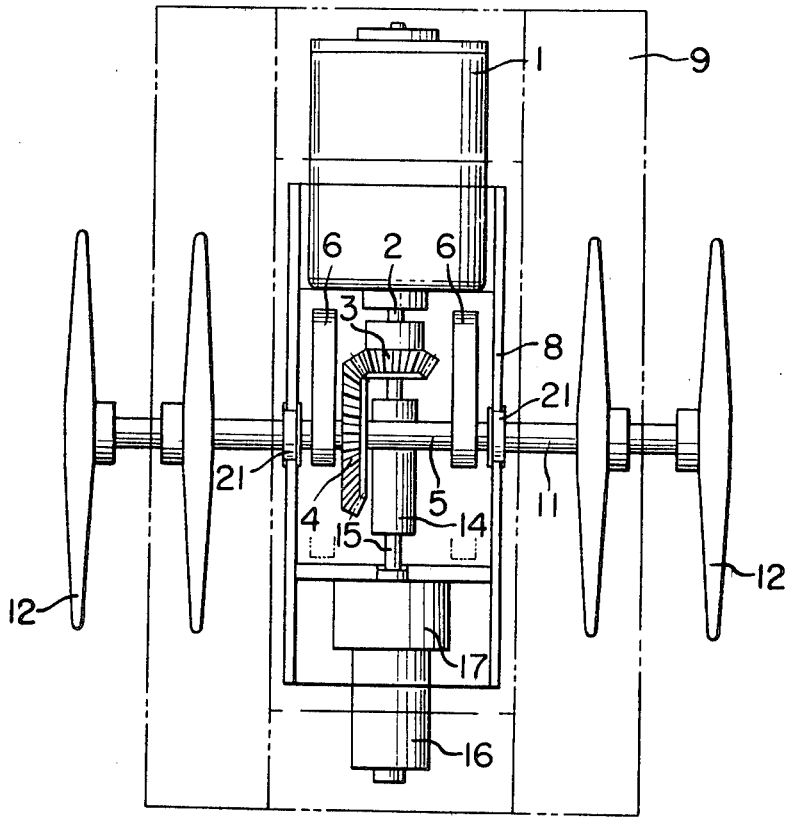
FIG. 2 is a crosssection taken along the line A—A of FIG. 1.
Figure 3:
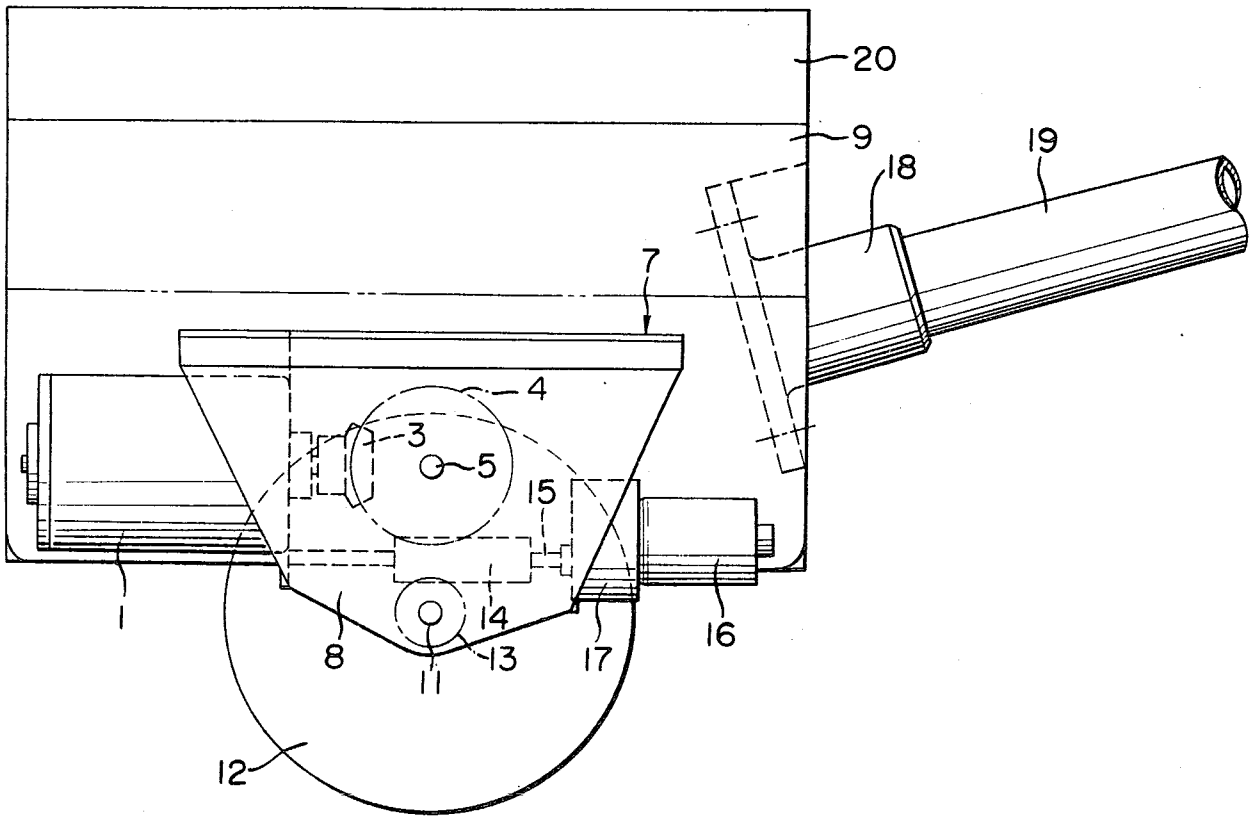
FIG. 3 is a crosssection taken along the line B—B of FIG. 1.

In FIGS. 1 through 3, reference numeral 1 refers to a motor for generating vibration; 2 to a motor shaft; 3 and 4 to bevel gears; 5 to a shaft of the bevel gear 4; 6 to an eccentric cam; 7 to a vibrating plate; 8 to a frame; 9 to a device body; 10 to a resilient member; 11 to a wheel shaft; 12 to a wheel; 13 to a worm wheel; 14 to a worm; 15 to a shaft; 16 to a motor for driving wheels; 17 to a drive unit; 18 to a handle guide; 19 to a handle; 20 to a weight; 21 and 21 to bearings for the wheel shaft 11 provided on the frame 8, respectively.

In FIGS. 1 through 3 illustrating the construction of a first beauty treatment device embodying this invention, which has a vibrating mechanism and an automatic travelling mechanism, the bevel gear 3 is firmly fitted to the vibration generating motor 1 via the shaft 2, as clearly indicated in FIG. 2. On the shaft 5 of the bevel gear in mesh with the bevel gear 3, two eccentric cams 6 of the same shape are mounted at a predetermined interval. The eccentric cam 6 may be of a sector shape with the shaft 5 fixed to the pivot thereof. As the eccentric cam 6 is rotated around the shaft 5, the frame 8 to which the shaft is supported is caused to vibrate, whereby the bearings 21 and 21 supporting the wheel shaft 11 are caused to vibrate. The frame 8 is rockably supported by the device body 9 at the portion of the vibrating plate 7 via the resilient member 10.

At both ends of the wheel shaft 11, one or two wheels 12 and 12 each are provided as shown in the figure, depending on the weight of the weight 20. The periphery of the wheel 12 is sharply edged so that the vibrating effect of a downward pushing force applied to the wheel 12 can be penetrated deep into the muscular tissue beneath the skin surface, that is, the pushing force per unit area can be increased.

The wheel 12 is caused to rotate by the worm 14 in mesh with the worm wheel 13 fixedly fitted to the wheel shaft 11. The worm 14 is connected via the shaft 15 to the drive unti 17 for regulating the revolution of the wheel driving motor 16. As the motor 16 rotates, the wheel 12 is caused to rotate at a relatively low speed, and thereby the device body 9 is caused to travel on the skin surface.

The operation of the beauty treatment device of this invention having such a construction will be described in the following. In operation, the beauty treatment device of this invention is placed on the back of a human body where the brown adipose tissue as described earlier in this Specification exists. Since the location of the brown adipose tissue varies with individual persons, the wheels 12 are caused to rotate by rotating the wheel driving motor 16 while applying vibration to the wheels to give stimuli to the brown adipose tissue.

That is, as the wheel driving motor 16 rotates, the revolution of the motor 16 is reduced to an appropriate speed by the drive unit 17 and transmitted to the shaft 15. As the worm 14 fitted to the shaft 15 is in mesh with the worm wheel 13, the revolution of the shaft 15 is further reduced and transmitted to the wheel shaft 11, causing the wheels 12 fitted to the wheel shaft 11 to rotate. This permits the beauty treatment device to automatically travel forward. On the other hand, the revolution of the vibration generating motor 1 is turned 90° in the axial direction thereof by the meshing of the bevel gears 3 and 4, causing the eccentric cam 6 fitted to the shaft 5 to rotate. As the eccentric cam 6 is rotated, the frame 8 is caused to vibrate as described above. The vibration thus generated is transmitted to the wheel shaft 11 via the bearings 21 and 21 and then to the wheels 12. Since the edges of the wheels 12 are formed sharply, the sharp edges of the wheels 12 depressed by the weight 12 give vibration to the skin surface while penetrating deep into the skin surface. Thus, a vibration effect can be given to the muscular tissue deep beneath the skin surface. In operation, the operator simply holds the handle 19 as shown in FIG. 3 to keep the device body 9 from falling as the device body 9 travels on the skin surface.

The beauty treatment device of this invention can be moved back and forth for ease of travel by using a reversible motor as the wheel driving motor 16. In doing so, the handle 19 provided on the device body 9 facilitates the control of the device by the operator. Furthermore, concentrated massaging at a limited location can be given by stopping the revolution of the wheel driving motor 16.

Figure 4:
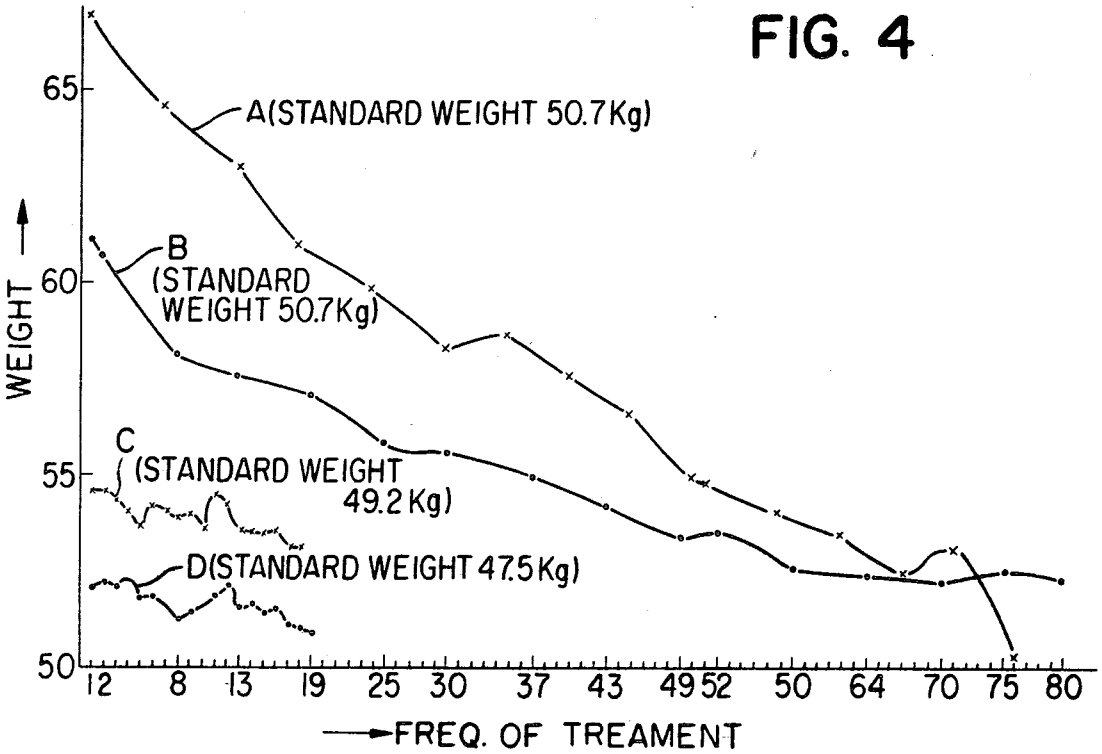
FIG. 4 is a diagram illustrating the test results using a beauty treatment device embodying this invention, as shown in FIG. 1, with one wheel each disposed at both ends of the wheel shaft, to compare with the test results using a conventional beauty treatment device.

The curve A of FIG. 4 shows changes in the weight of a twenty-year-old woman weighing 67.0 kg on a 153.1-cm frame when massage was given to her back, using a conventional type beauty treatment device, for about an hour every morning, excluding Saturday and Sunday. The ordinate of the graph represents weight and the abscissa the frequency of treatment. The curve B of FIG. 4 shows changes in the weight of a forty-six-year-old woman weighing 61.0 kg on a 157.2-cm frame when massage was practiced under the same condition as with the curve A.

As is evident from the experiment results, massaging the entire back surface with an increased pushing force per unit area had a pronounced effect to stimulate the brown adipose tissue, as described earlier in the present Specification with reference to the prior art.

The subjects testified that they felt hot in their back during the experiments. As described above, however, massaging with the conventional beauty treatment device requires the operator to expend considerable labor since he has to apply his weight onto the back of a patient with the handle in his hands.

The curve C of FIG. 4 shows changes in the weight of a 31-year-old woman weighing 54.55 kg on a 150.5-cm frame when she was subjected to massaging using the beauty treatment device of this invention shown in FIG. 1, which has one wheel 12 each on both sides, for 30 minutes every morning, excluding Saturday and Sunday. The curve D of FIG. 4 shows changes in the weight of a 25-year-old woman weighing 51.95 kg on a 147.6-cm frame when she was subjected to massaging under the same conditions as with the curve C.

Although the curves C and D with the beauty treatment device of this invention represent the part-way changes, they appear to have slower slopes than the curves A and B, but clearly indicate a downward trend in weight. This seems to suggest, therefore, that the beauty treatment device of this invention can achieve almost the same effect as the conventional beauty treatment device. The slower slopes of the curves C and D are attributable to that the subjects for the experiments represented by the curves A and B were women substantially overweighing their standard weights whereas the subjects represented by the curves C and D were those overweighing their standard weights to a lesser degree.

As described above, this invention makes it possible to give massage to the muscular tissue deep beneath the skin surface by mechanically applying pushing force without the need for heavy human labor, thus enabling the operator to handle the device very easily.

With the first embodiment described above, however, the magnitude of vibration varies with the weight of the device body because the wheels are caused to vibrate by the centrifugal force generated by the eccentric cam revolving around the pivot thereof. In other words, when the weight of the device body is increased to increase the pushing force onto the skin surface, the amplitude of the vibration tends to be reduced.

The second embodiment of this invention as shown in FIGS. 5 through 10 is intended to overcome the aforementioned problem. In FIGS. 5 through 10, numeral 101 refers to a vibration generating motor; 102 to a motor shaft; 103 and 104 to bevel gears; 105 to a transmission shaft; 106 and 106 to transmission gears; 107 to a bearing (for the transmission shaft); 108 to a gear housing; 109 and 109 to vibrations gears with eccentric shaft holes; 110 to an eccentric shaft hole; 111 to a gear bearing; 112 to a wheel shaft; 113 to a bearing (for the wheel shaft); 114 and 114 to wheels; 115 to a worm wheel; 116 to a worm shaft; 117 to a worm gear; 118 to a bearing; 119 to a worm gear box; 120 to a bearing (for the worm shaft); 121 to a thrust bearing; 122 and 122' to universal joints; 123 to a wheel driving motor; 124 to a reduction gear; 125 to an output shaft of the reduction gear 124; 126 and 126' to connecting pins; 127 and 127' to through holes; 128 to a rubber vibration insulator; 129 to a device body; 130 and 131 to handles; 132 to a DC stabilized power supply circuit; 133 to a slide rheostat; 134 and 135 to constant voltage circuits; 136 and 137 to changeover switches, respectively.

Figure 5:
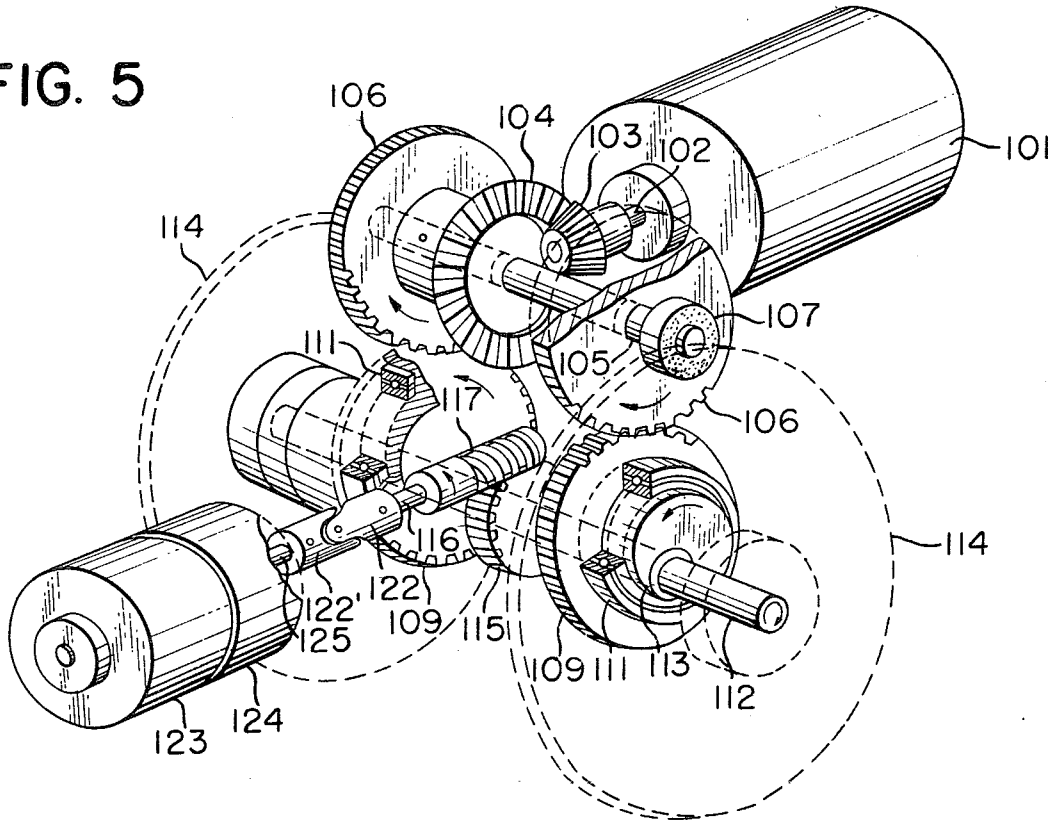
FIG. 5 is a perspective view illustrating the construction of a second beauty treatment device embodying this invention.
Figure 6:
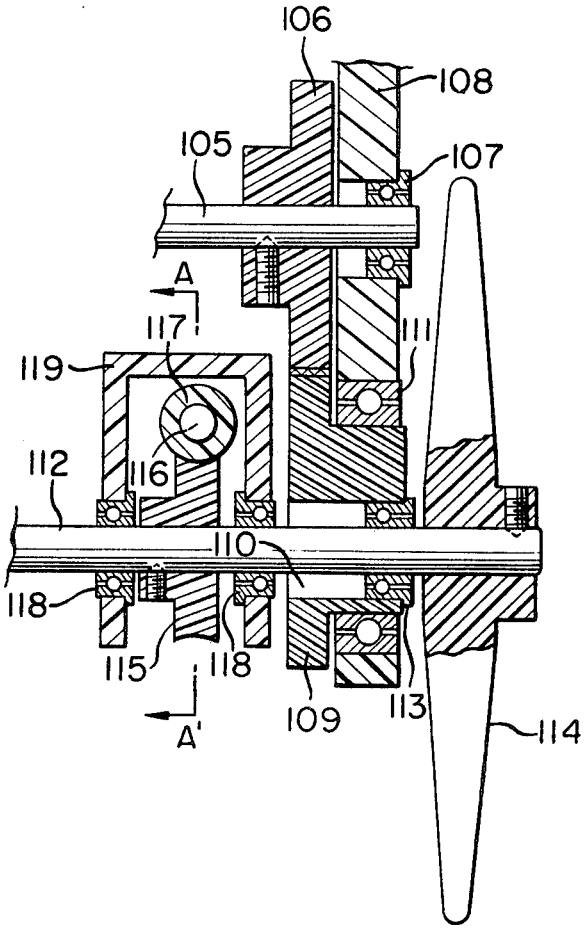
FIG. 6 is a crosssection of the key components of the second embodiment as shown in FIG. 5.
Figure 7:
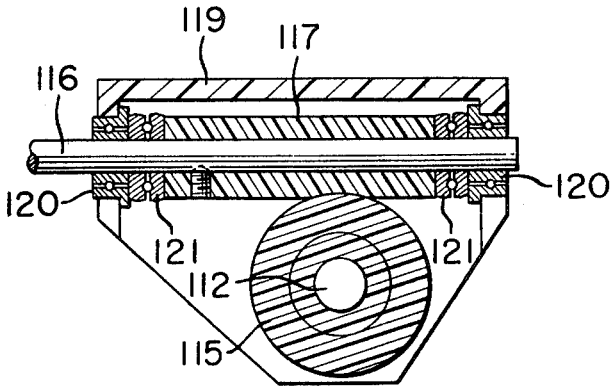
FIG. 7 is a crosssection taken along the line A—A' of FIG. 6.
Figure 8:
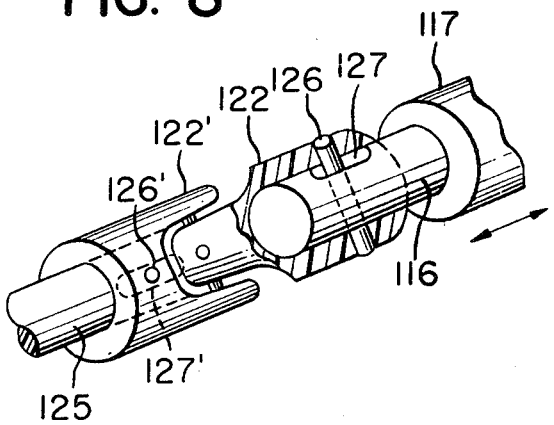
FIG. 8 is an enlarged view of the universal joint (122 and 122') portion of FIG. 5.

In FIGS. 5 through 9, the bevel gear 103 is fixedly fitted to the motor shaft 102 of the vibration generating motor 101, as shown in FIG. 5. The bevel gear 103 engages with the bevel gear 104 fixedly fitted to the transmission shaft 105 supported by the gear housing 108 (which is omitted in FIG. 5 but shown in FIGS. 6 and 9) via the bearing 107. Furthermore, the transmission gear 106 is fixedly fitted to the transmission shaft 105. The gears 109 and 109 with the eccentric shaft holes 110 and 110 are rotatably supported by the gear housing 108 (shown in FIG. 6) via the gear bearings 111 and 111 in such a manner as to engage with the transmission gears 106 and 106. As shown in FIG. 6, the gear 109 has the eccentric shaft hole 110 by which the wheel shaft 112 is supported via the bearing 113. Two pieces of the gears 109 with the eccentric shaft holes 110 supporting the wheel shaft 112 are provided as shown in FIG. 5, and driven by the transmission gears 106 and 106. The wheels 114 and 114 are fixedly fitted to both ends of the wheel shaft 112. Consequently, as the vibration generating motor 101 is driven, the revolution of the motor 101 is transmitted to the gears 109 with the eccentric shaft holes 110 via the motor shaft 102, the bevel gears 103 and 104, the transmission shaft 105 and the transmission gear 106. Thus, the wheel shaft 112 supported at an off-center position with respect to the rotation center of the gears 109 with the eccentric shaft holes 110, and the wheels 114 fixedly fitted to the wheel shaft 112 are caused to move around in a circular orbit.

Figure 9:
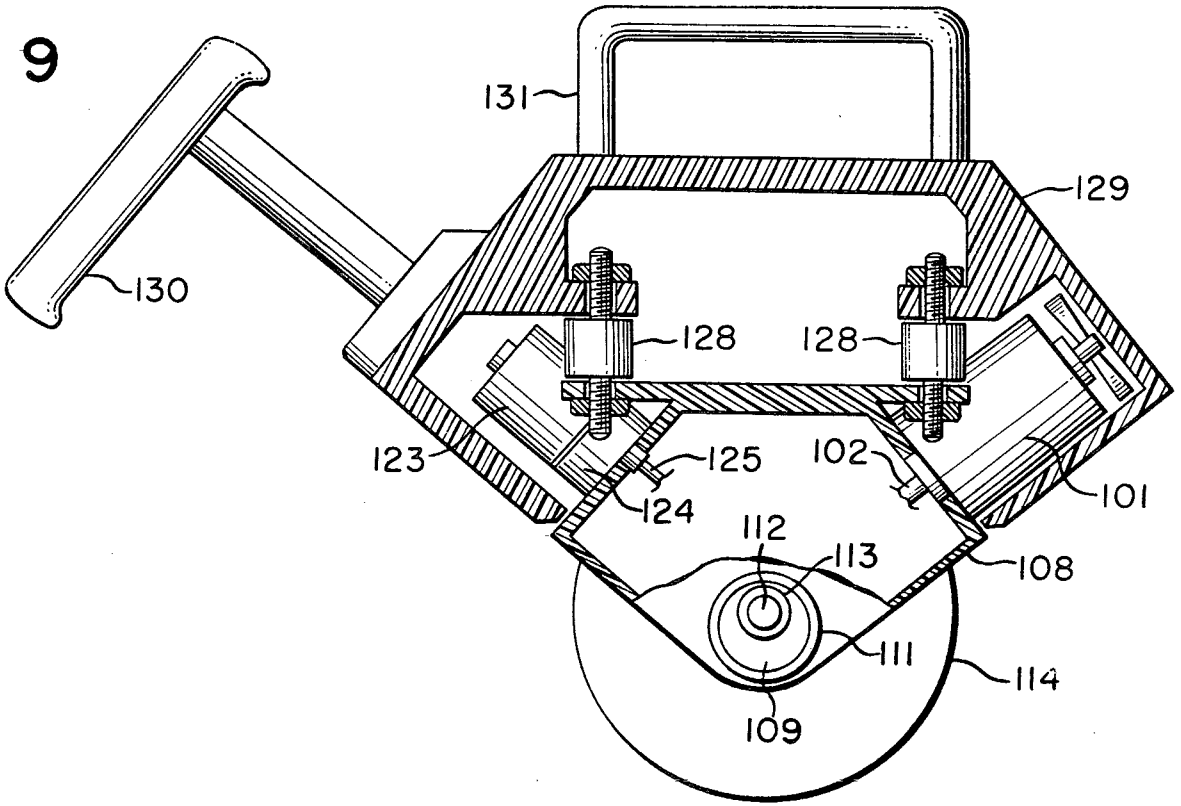
FIG. 9 is a sectional side elevation of the second embodiment of this invention.

Next, the revolution of the wheel shaft 112 and the wheels 114 on the axis thereof will be described. As is clearly shown in FIG. 6, the worm wheel 115 is fixedly fitted to the wheel shaft 112 and in mesh with the worm gear 117 fixedly fitted to the worm shaft 116. The worm shaft 116 is supported by the worm gear box 119 supported by the wheel shaft 112 via the bearings 118 and 118, as shown in FIG. 6, or more particularly via the bearings 120 and 120 and the thrust bearings 121 and 121, as more clearly shown in FIG. 7. Furthermore, the worm shaft 116 is connected to the output shaft 125 of the reduction gear 124 via the universal joints 122 and 122'. As described earlier, the wheel shaft 112 moves around in a circular orbit as the gears 109 with the eccentric shaft holes 110 are rotated. Consequently, the worm shaft 116 supported by the worm gear box 119 supported by the wheel shaft 112 via the bearings 118 and 118 also moves around in a circular orbit, together with the wheel shaft 112. As shown in FIG. 9, however, the reduction gear 124 is fixed to the gear housing 108. This arrangement inevitably causes misalignment of the worm shaft 116 with the output shaft 125 of the reduction gear 124 since the worm shaft 116 moves up and down as the wheel shaft 112 moves around in a circular orbit. To correct this misalignment, the universal joints 122 and 122' are interposed between the worm shaft 116 and the output shaft 125 of the reduction gear 124. Furthermore, to allow for the axial displacement of the worm shaft 116 in the direction shown by an arrow in FIG. 8, caused by the orbiting motion of the wheel shaft 112, the through holes 127 and 127' are provided on the worm shaft 116 and the output shaft 125, respectively. The connecting pins 126 and 126' are inserted in the through holes 127 and 127' and fixed to the universal joints 122 and 122' in such a manner that the connecting pins can slide in the through holes 127 and 127' in the direction shown by the arrow in FIG. 8. With this arrangement, the revolution of the output shaft 125 can be smoothly transmitted to the worm shaft 116 despite the vertical and axial movement of the worm shaft 116.

Thus, the revolution of the wheel driving motor 123 is reduced in speed by the reduction gear 124 and transmitted to the output shaft 125, causing the wheels 114 to rotate via the universal joints 122' and 122, the worm shaft 116, the worm gear, the worm wheel 115 and the wheel shaft 112.

As described above, the second embodiment of this invention has such a construction that the wheels 114 are caused to rotate on the axis thereof by a travelling mechanism using the wheel driving motor 123 as a drive unit, and at the same time are caused to a move around in a circular orbit by a vibrating mechanism using the vibration generating motor 101 as the drive unit thereof. Furthermore, the gear housing 108 on which the vibrating mechanism incorporating the wheels 114, the vibration generating motor 101, and the travelling mechanism incorporating the wheel driving motor 123 are mounted is fitted to the device body 129 via the rubber vibration insulators 128 and 128. The device body 129 has the handles 130 and 131.

Now, the operation of the second embodiment of this invention having the aforementioned construction will be described in the following.

The beauty treatment device as the second embodiment of this invention is placed on the back of a person where the brown adipose tissue exists, as described in the Description of the Prior Art of the present Specification. Since the location of the brown adipose tissue varies with individual persons, the device is caused to travel on the skin surface by rotating the wheels 114 around the axis thereof by the travelling motor 123 while causing the wheels 114 to move around in a circular orbit by the vibration generating motor 101. Furthermore, the device can be easily moved to a desired massaging position since the rotating speed and rotating direction of the travelling motor 123 can be controlled, as will be described later, referring to FIG. 10, and the direction of travelling of the device can also be controlled easily by the handle 131.

Although the pushing force of the device onto the skin surface is determined by the total weight of the device, which may be 4 or 8 kg, the optimum massaging effects can be achieved partly because the sharp edges of the wheels 114 dent deep into the skin of the back while giving vibration to the skin, partly because the amplitude of vibration is maintained constant at all times by the constant radius of the circular orbit of the wheel 114 even when the pushing force by the weight of the device varies, and partly because the period of the orbital motion of the wheels 114 can be set at a desired value by controlling the rotating speed of the vibration generating motor 101.

Figure 10:
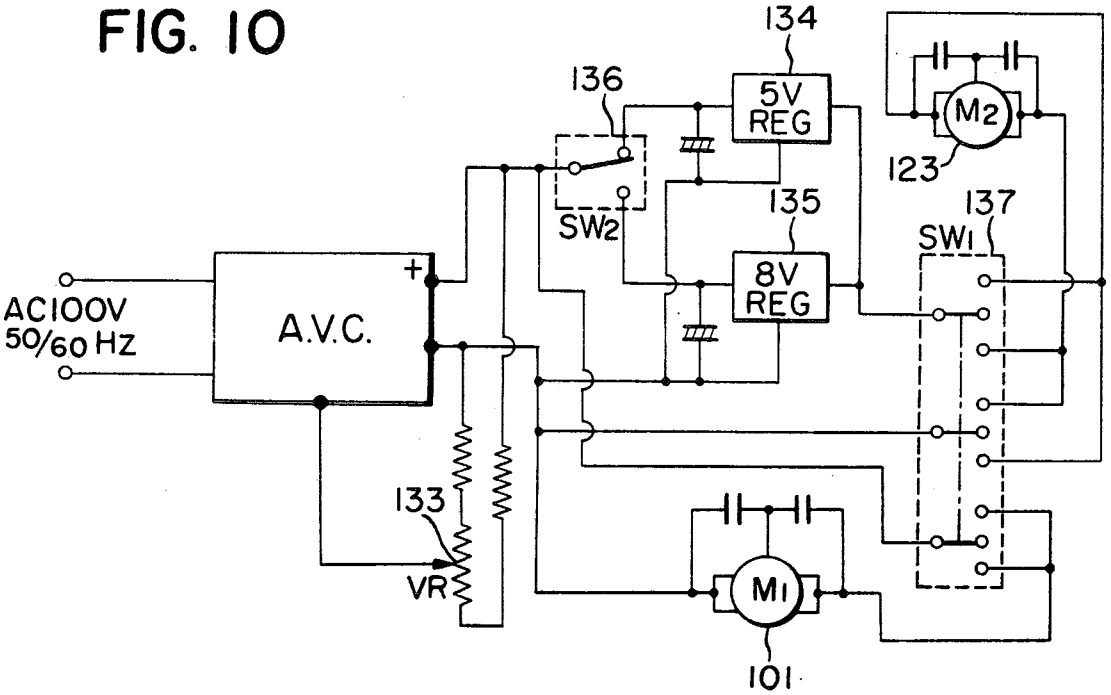
FIG. 10 is a circuit diagram of the control circuit of the second embodiment of this invention.

FIG. 10 is a circuit diagram of a control circuit for the vibration generating motor 101 and the travelling motor 123. The d-c stabilized power supply circuit 132 is capable of converting 100 V a-c into an output d-c voltage within a controlled range of 7 to 12 V. The output d-c voltage can be set by changing the setting of the variable resistor 133. The output voltage of the d-c stabilized power supply circuit 132 is fed to the vibration generating motor 101 via the contacts of the changeover switch 137, causing the motor 101 to revolve at the number of revolution corresponding to the magnitude of voltage supplied. Thus, the period of vibration, or orbital motion, of the wheels 114 is determined by the magnitude of the output voltage of the d-c stabilized power supply circuit 132. Furthermore, the output voltage of the d-c stabilized power supply circuit 132 is fed to the constant voltage circuit 134 or 135 via the changeover switch 136. When the changeover switch 136 is thrown to the upper side of the figure, the constant voltage circuit 134 produces an output voltage of 5 V even when the input voltage varies within the range of 7 to 12 V, as described above. When the changeover switch 136 is thrown to the lower side of the figure, the constant voltage circuit 135 produces an output voltage of 8 V so long as the input voltage is higher than 8 V. When the input voltage is lower than 8 V, the constant voltage circuit 135 produces an output voltage equal to the input voltage. The output voltage of the constant voltage circuit 134 or 135 is supplied to the travelling motor 123 via the changeover switch 137, causing the beauty treatment device to travel at a speed corresponding to the magnitude of voltage supplied to the motor 123. Furthermore, the beauty treatment device can be caused to travel back and forth by changing over the changeover siwtch 137 to the upper or lower side in the figure.

As described above, the second embodiment of this invention makes it possible to provide a beauty treatment device capable of exhibiting the following distinguished effects. That is, the vibrating force is applied evenly to the skin surface not only in the vertical direction with respect to the skin but also in the back and forth direction, that is, the travelling direction of the wheels. Since the radius of the orbiting motion of the wheels is constant, the amplitude of vibration of the wheels is maintained constant even when the pushing force is changed. The period of vibration can be set at a desired value by controlling the rotating speed of the vibration generating motor. The pushing force, or the massaging force, can be changed to a desired level by adjusting the weight of the beauty treatment device. The beauty treatment device is capable of automatically travelling on the skin surface, during treatment, with the operator holding the handle to prevent the device from falling. This gives less fatigue to the operator even for long hours of treatment. Since the travelling speed of the device can be controlled at a constant level, a predetermined amount of massaging can be achieved. Massaging with the sharp edges of the wheels gives a massaging effect deep into the subcutaneous muscular tissue. Massaging is possible by causing the device to travel on the back of the patient who lies down on his face. Although the aforementioned first and second embodiments are concerned with the beauty treatment device of the self-travelling type, the device can be caused to travel on the skin surface by pushing the handle of the device by the operator.

In the aforementioned first and second embodiments of this invention, the pushing force onto the skin surface, that is, the stimulus to the skin, varies not only with the weight of the weight, the amplitude of vibration, etc. but also with the sharpness of the edges of the wheels. The magnitude of the pushing force must be adjusted in accordance with the portion of the body being massaged, that is, the portion where thick muscular or adipose tissues exist, or the portion where only thin muscular or adipose tissues exist and the bone lines close to the skin. Furthermore, the pushing force must be adjusted in accordance with the individual difference in figure, that is, whether the patient is of slender build or of pyknic type, or in accordance with the patient's experience with the beauty treatment device, that is, whether or not the patient is familiar with the device. However, the weight of the device or the amplitude of vibration cannot be easily changed because both the device weight or the vibration amplitude are almost prefixed with the type of device. In order to obtain the desired pushing force, therefore, it is desirable to change wheels for those having edges of appropriate sharpness. To achieve this, a beauty treatment device having such a construction that wheels can be easily changed is desired.

The third through fifth embodiments as shown in FIGS. 11 through 15 are intended to meet the aforementioned need.

Figure 11A:
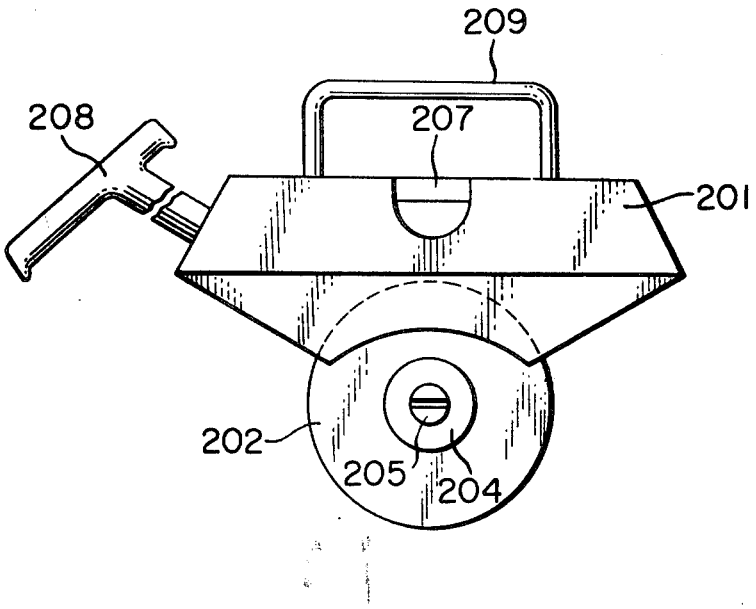
FIG. 11 (A) and (B) are front and side views of a third beauty treatment device embodying this invention.
Figure 11B:
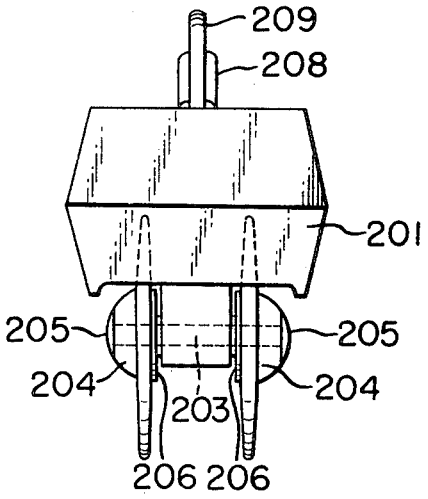

In FIG. 11, reference numeral 201 refers to a device body; 202 to a wheel; 203 to a wheel shaft; 204 to a wheel cap; 205 to a screw for fixing the wheel; 206 to a hub; 207 to a weight; 208 and 209 to handles; 206' to a projection of the hub 206 for preventing the wheel 202 from moving in the direction of rotation when the wheel 202 is fitted to the hub 206; 210 to a hub insert hole formed into a shape corresponding to the hub 206; 210' to a recess for receiving the hub projection 206'; 211 to a tapped thread to which the wheel fixing screw 205 is screwed; 212 to a device frame; 213 to a spring washer; 214 to a retainer ring; 215 to a bearing; 216 to an eccentric gear, respectively.

The third embodiment of this invention, as shown in FIG. 11, is placed on the skin surface being treated and the edges of the wheels 202 are caused to dent into the skin surface by the weight of the device body 201 and the weight 207. As described with reference to the first and second embodiments of this invention, the third embodiment also has such a construction that massaging is effected by causing the wheels 202 to rotate by means of the wheel driving mechanism (not shown) incorporated in the device body 201 to cause the device to travel on the skin surface. The third embodiment is also constructed so that massaging effects can be increased by causing the wheel 202 to vibrate by means of the vibration generating mechanism (not shown). The third embodiment of this invention has a wheel changing mechanism which permits the wheels 202 to be changed for those having edges of appropriate sharpness so as to give the optimum stimulus to the skin during massaging. Although the wheel changing mechanism of the third embodiment will be described later, referring to FIGS. 12 through 15, the wheel cap 204, the wheel fixing screw 205 and the hub 206 shown in FIG. 11 are provided for this purpose.

Now, the wheel changing mechanism in the third embodiment will be described in the following, referring to FIG. 12.

Figure 12:
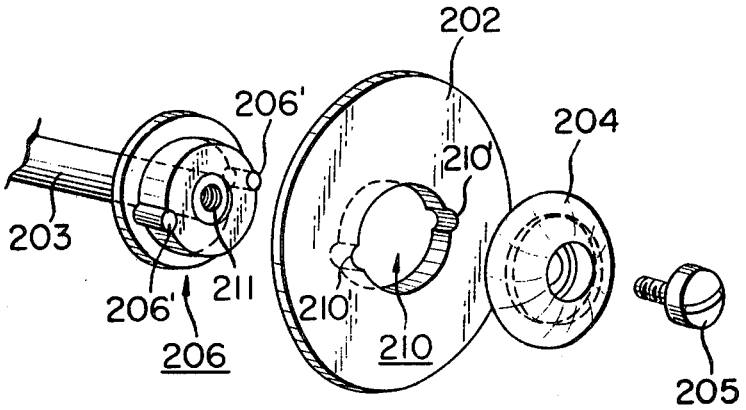
FIG. 12 is a perspective view of a wheel changing mechanism in the third embodiment of this invention.

In the wheel changing mechanism of the third embodiment shown in FIG. 12, the hub 206 is fixedly fitted to an end of the wheel shaft 203, and the wheel 202 is fitted to the hub 206 in such a manner that the hub insert hole 210 of the wheel 202 engages with the hub 206, that is, the recesses 210' and 210' of the hub insert hole 210 engage with the hub projections 206' and 206' provided on the hub 206. The wheel 202 is easily fixed to the wheel shaft 203 by screwing the wheel fixing screw 205 to the tapped thread 211 provided on the wheel shaft 203 with the wheel cap 204 interposed between the screw 205 and the wheel 202. That is, the wheel 202 is prevented from moving in the rotating direction by the recesses 210' and 210' engaging with the hub projections 206' and 206', and at the same time prevented from moving in the axial direction by the wheel fixing screw 205 screwed to the wheel shaft 203 via the wheel cap 204. The wheel 202 can be easily removed by loosening the wheel fixing screw 205 with a screw driver or a coin, for example. As described above, the third embodiment shown in FIG. 12 has a simple construction enabling wheels to be easily mounted and removed from the wheel shaft. It is of course possible to form recesses on the hub 206 and projections on the wheel 202.

Figure 13:
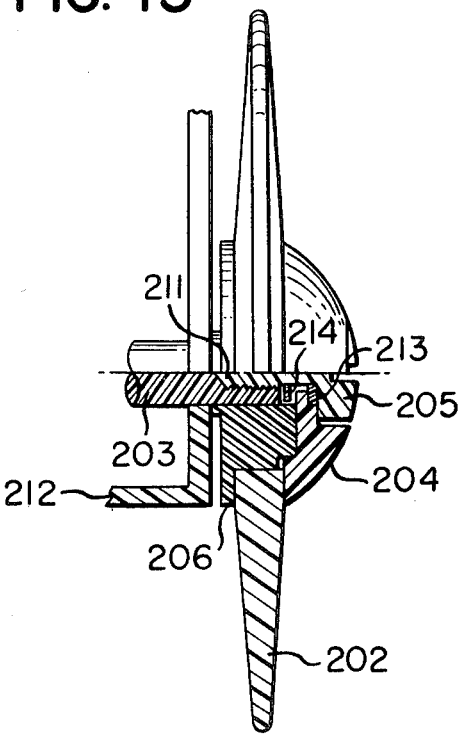
FIG. 13 is a sectional side elevation of a wheel changing mechanism in a fourth embodiment of this invention.
Figure 14:
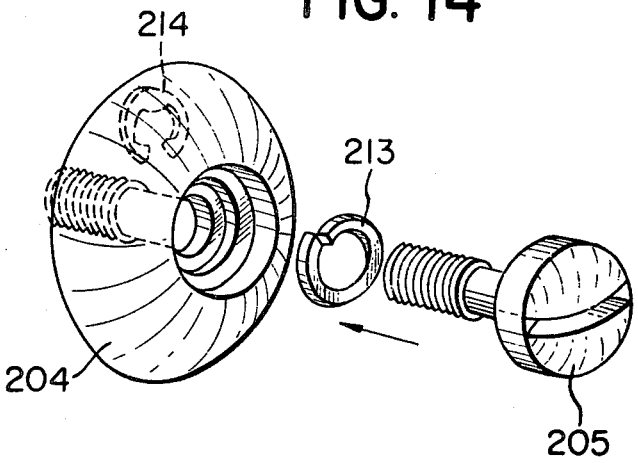
FIG. 14 is a partical perspective view of the embodiment shown in FIG. 13.

In the fourth embodiment shown in FIGS. 13 and 14, another type of wheel changing mechanism is employed. Since the basic construction of this wheel changing mechanism is essentially the same as that of the third embodiment shown in FIG. 12, detailed description of the mechanism has been omitted here. In short, the spring washer 213 is used in fixing the wheel 202 to the wheel shaft 203 by the wheel fixing screw 205 so as to more positively preventing the wheel 202 from moving in the axial direction. In order to prevent the spring washer 213 and other small parts from being scattered and lost when the wheel 202 is removed from the wheel shaft 203, and to eliminate the need for assembling the wheel fixing screw 205, the spring washer 213 and the wheel cap 204 into one unit every time installing the wheel 202 to the wheel shaft 203, the wheel fixing screw 205, the spring washer 213 and the wheel cap 204 are left as assembled, or in a captive state, when the wheel 202 is removed from the wheel shaft 203, as will be described later, referring to FIG. 14. That is, the retainer ring 214 as shown by dotted lines in FIG. 14 is fitted to the wheel fixing screw 205 at the portion shown by an arrow in the figure, after the wheel fixing screw 205 is passed through the spring washer 213 and the wheel cap 204. This arrangement makes it possible to retain the wheel fixing screw 205, the spring washer 213 and the wheel cap 204 in a captive state even when the wheel 202 is removed from the wheel shaft 203, and to remove the wheel 202 from the hub 206 simply by removing the whole assembly of the wheel fixing screw 205, the spring washer 213 and the wheel cap 204 from the wheel shaft 203.

Figure 15:
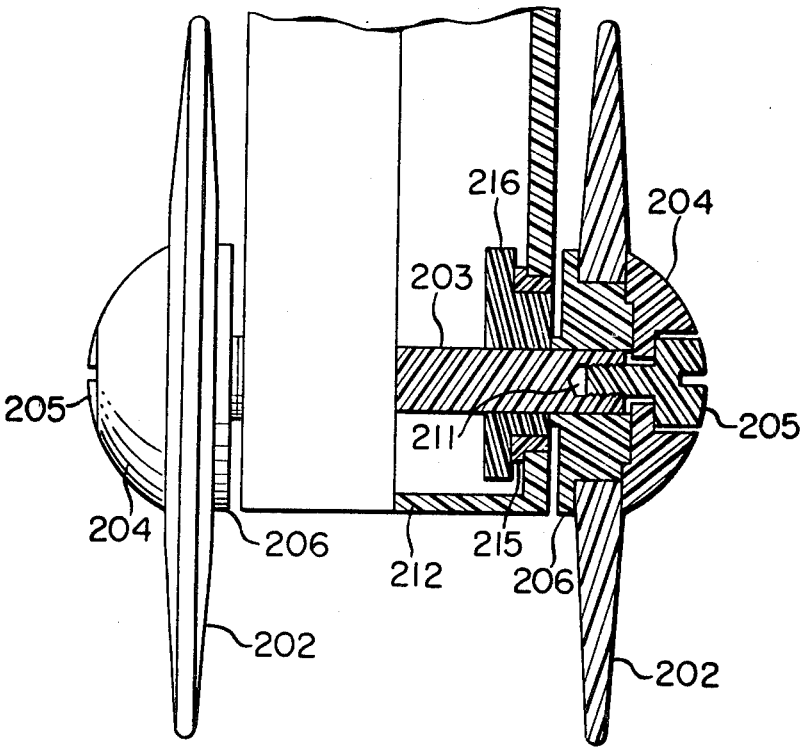
FIG. 15 is a sectional side elevation of a wheel changing mechanism in a fifth embodiment of this invention.

FIG. 15 shows the wheel changing mechanism employed in the fifth embodiment of this invention. Since the basic construction of this wheel changing mechanism is also essentially the same as those of the third and fourth embodiments shown in FIGS. 12 and 13, detailed description thereof has been omitted here. In the fifth embodiment shown in FIG. 15, the wheel shaft 203 is rotatably supported by the eccentric gear 216, and the eccentric gear 216 is rotatably supported by the frame 212 via the bearing 215. The wheel shaft 203 is driven by the wheel driving mechanism (not shown in the figure), and the eccentric gear 216 is driven by the vibration generating mechanism (not shown). That is, the wheel shaft 203 which is eccentrically supported by the eccentric gear 216 is caused to make an eccentric rotary motion as the eccentric gear 216 is rotated. As a result, the wheel 202 gives a vibrating effect to the skin surface.

As described above, the third through fifth embodiments of this invention make it possible to change wheels for those having edges of a desired sharpness so as to give the optimum massaging effect to the skin surface.

In roder to achieve the expected beauty treatment effect through massaging by a beauty treatment device, it is necessary to give considerably stimulative vibrations to the muscular tissue. And these stimulative vibrations must give comfort, not pain, to the patient being treated. However, the wheels used in the beauty treatment device as proposed above are made of a rigid material such as a rigid synthetic resin, which may give pain to the patient when the pushing force to the skin surface is increased, or strong vibrations are exerted.

Figure 16A:
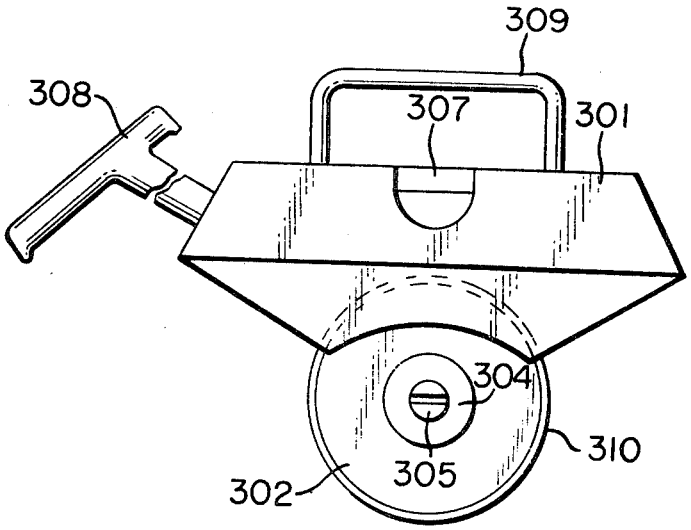
FIGS. 16 (A) and (B) are front and side views of a sixth embodiment of this invention.
Figure 16B:
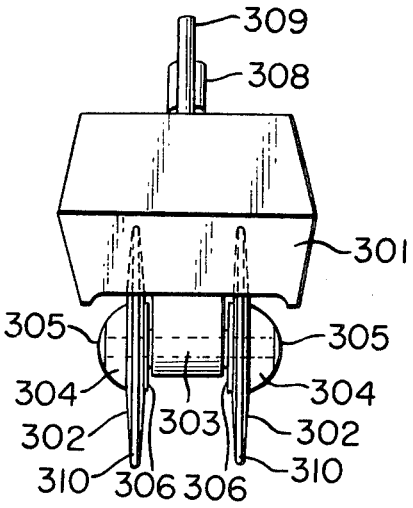

The sixth and seventh embodiments of this invention shown in FIGS. 16 (A), (B) through 21 (A)-(F) are intended to overcome the above problems.

In FIGS. 16 (A), (B) through 21 (A)-(F), reference numeral 301 refers to a device body; 302 to a wheel; 303 to a wheel shaft; 304 to a wheel cap; 305 to a wheel fixing screw; 306 to a hub; 307 to a weight; 308 and 309 to handles; 310 to a tire, made of a resilient material such as rubber, synthetic resin or the like; 311 to an annular recess provided on the outer edge of the wheel 302; 313 to an annular projection provided on the inner edge of the tire 310; 313 to an annular projection provided on the outer edge of the wheel 302; 314 to an annular recess provided on the inner edge of the tire 310, respectively.

As shown in FIGS. 16 (A) and (B), the sixth embodiment of this invention is placed on the skin surface being massaged. In this state, the edges of the wheels 302 are caused to dent into the skin surface by the weight of the device body 301 and the weight 307. As described in detail with reference to the first and second embodiments, massaging is effected while the device is caused to travel on the skin surface as the wheels 302 are rotated by the wheel driving mechanism incorporated in the device body, as shown in FIGS. 2, 3 and 5. Furthermore, massaging effects can be enhanced by causing the wheels 302 to vibrate by the vibration generating mechanism shown in FIGS. 2, 3 and 5.

In order to give the optimum stimulus to the skin during treatment, the sixth and seventh embodiments of the invention shown in FIG. 16 are constructed so that the tire 310, made of a resilient material and having a desired shape, can be fitted to the outer edge of the wheel 302, or can be easily changed.

The tire changing mechanism in the sixth and seventh embodiments of this invention will be described, referring to FIGS. 17 (A), (B) through 21 (A)-(F).

Figure 17A:
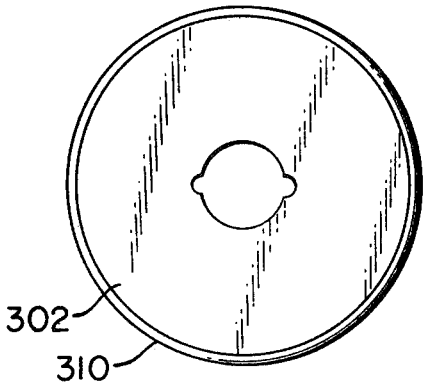
FIG. 17 (A) is a front view of a wheel being used in the sixth embodiment of this invention.
Figure 17B:
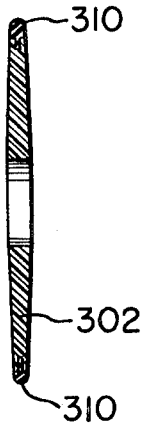
Figure 18A:
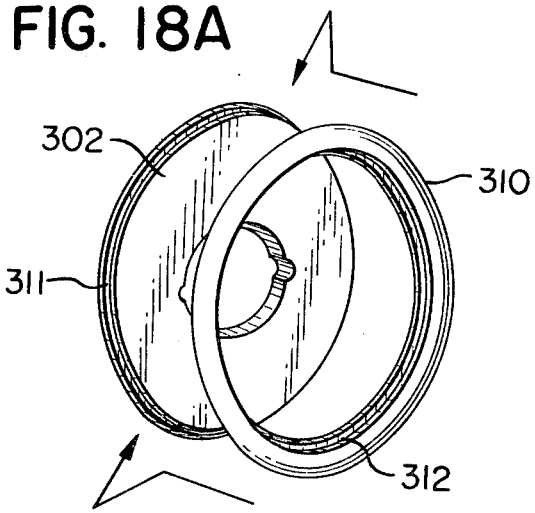
FIG. 18 (A) is a perspective view illustrating the relationship between the wheel and the tire in the sixth embodiment shown in FIG. 17.
Figure 18B:
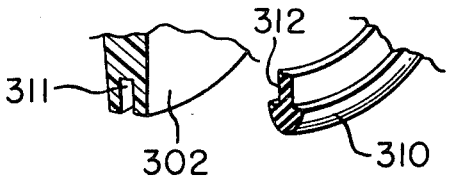

In the sixth embodiment shown in FIGS. 17 (A), (B) through 18 (A), (B), the wheel 302 has the annular recess 311 over the outer edge thereof, and the annular projection 312 for engaging with the annular recess 311 of the wheel 302 is provided over the inner edge of the tire 310. Consequently, as the annular projection 312 of the tire 310 is forced into the annular recess 311 of the wheel 302 as shown by arrows in FIG. 18 (A), the tire 310 is fitted to the wheel 302, just as a tire attached to the wheel rim of a bycycle (see FIGS. 17 (A), (B)). With this arrangement, the tire 310 of the optimum shape for specific massaging needs can be fitted to the wheel 302.

Figure 19A:
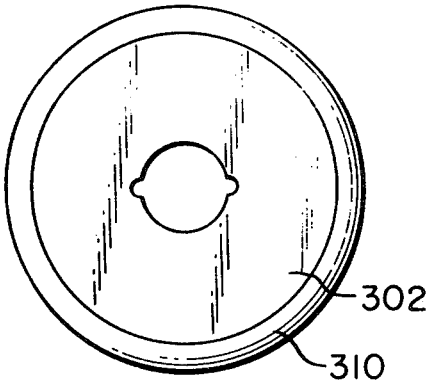
FIG. 19 (A) is a front view of the wheel portion of the seventh embodiment of this invention.
Figure 19B:
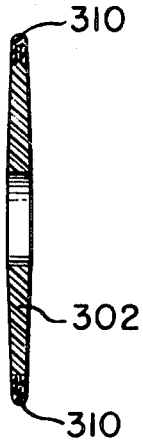
Figure 20A:
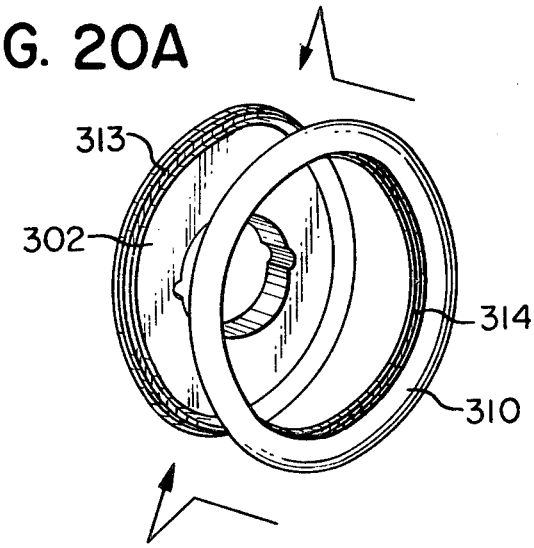
FIG. 20 (A) is a perspective view illustrating the relationship between the wheel and the tire in the seventh embodiment shown in FIG. 19.
Figure 20B:
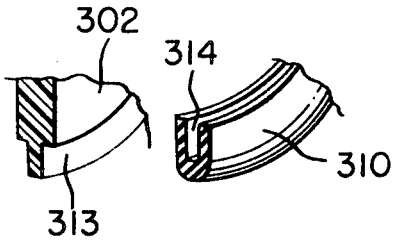
Figure 21A:
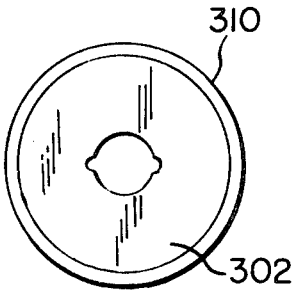
FIGS. 21 (A) through (F) are diagrams illustrating various shapes of tires being used in this invention.
Figure 21B:
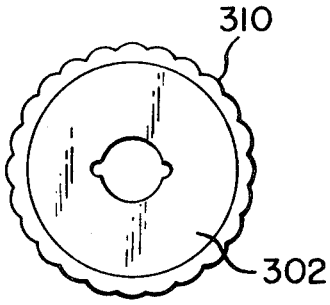
Figure 21C:
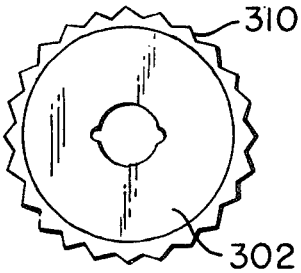
Figure 21D:
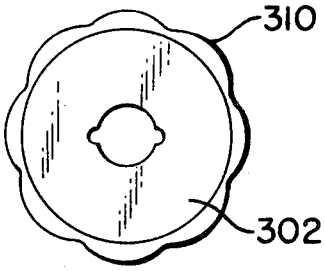
Figure 21E:
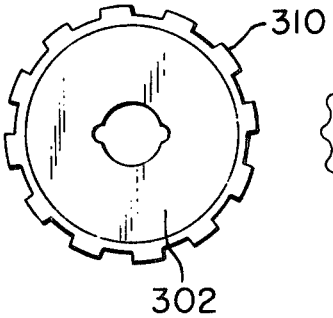
Figure 21F:
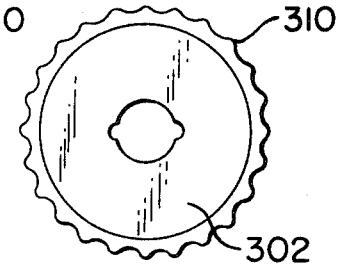

In the seventh embodiment of the invention shown in FIGS. 19(A), (B) and FIGS. 20 (A), (B), the annular projection 313 is provided over the outer edge of the wheel 302, and the annular recess 314 for engaging with the annular projection 313 is provided over the inner edge of the tire 310. Consequently, as the annular recess 314 of the tire 310 is fitted over the annular projection 313 of the wheel 302 as shown by arrows in FIG. 20 (A), the tire 310 is fitted over the wheel 302 (see FIGS. 19 (A), (B).) As described above with reference to the sixth embodiment, this arrangement allows the tire 310 of the optimum shape for a specific massaging need to be fitted to the wheel 302.

FIGS. 21 (A) through (F) show various shapes of the tire 310, from which the optimum shape for a specific massaging need can be selected. Needless to say, the tire 310, having the shapes shown in FIGS. 21 (A) through (F) has an annular recess or projection over the inner edge thereof for engaging with the corresponding shape of the wheel 302.

The tire 310 may be made of a resilient material such as rubber or synthetic resin, as described above, or of cork, etc. If a rubber magnet generating magnetism is used for the tire, the therapeutic effect of magnetism, together with the beauty treatment effect, can be expected. Magnets generating strong magnetism can be partially embedded in the tire.

As described above, the sixth and seventh embodiments of this invention, which employ simple tire changing mechanisms of fitting a tire over the wheel of the device, make it possible to carry out massage by giving the optimum stimulus to the skin in accordance with the attitude and figure of the patient by changing the tire to that of the optimum shape, and to replace a worn-out or broken tire with new one.

In the sixth and seventh embodiments of this invention, as described above, the pushing force onto the skin surface is adjusted by changing the shape of the edge of the wheel. However, a beauty treatment device capable of easily adjusting the pushing force is desired.

Figure 22A:
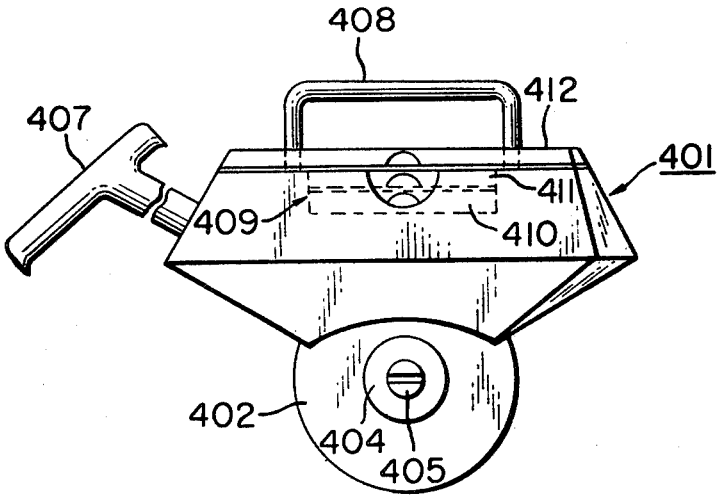
FIGS. 22 (A) and (B) are front and side views of an eighth beauty treatment device embodying this invention.
Figure 22B:
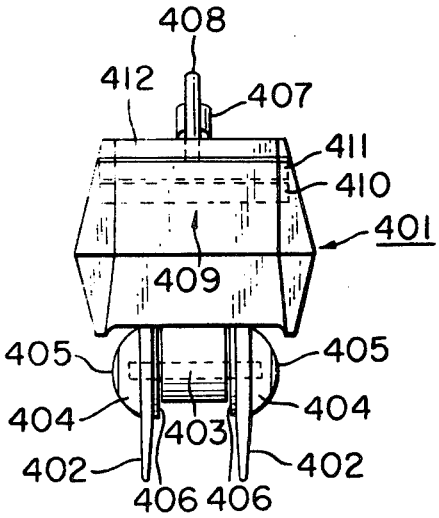
Figure 23:
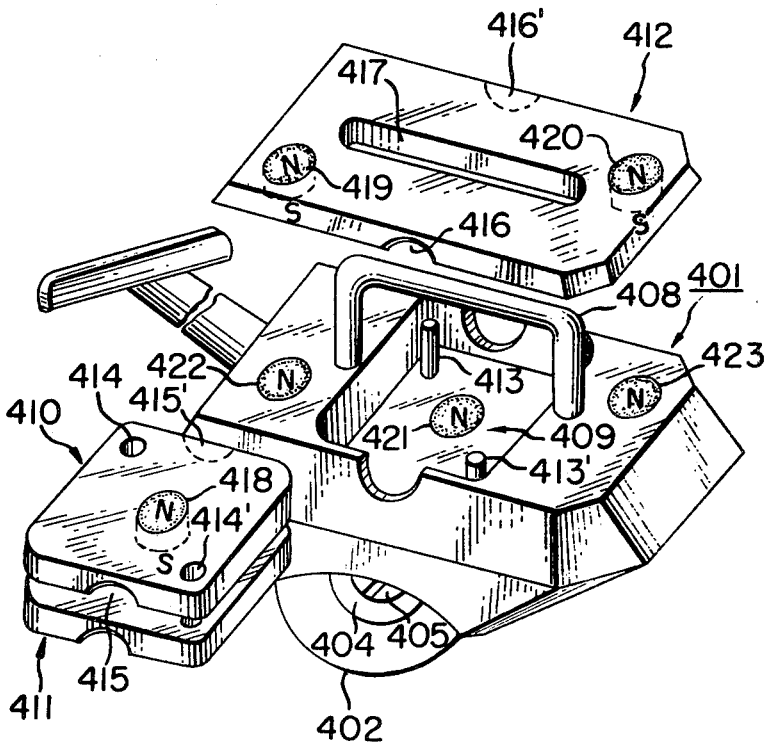
FIG. 23 is a perspective view illustrating a weight changing means in the eighth embodiment shown in FIG. 22.

The eighth embodiment of this invention shown in FIGS. 22 and 23 is intended to meet the aforementioned demand by making it possible to easily change the weight placed on the device body for that of an appropriate weight.

In FIGS. 22 and 23, reference numeral 401 refers to a device body; 402 to a wheel; 403 to a wheel shaft; 404 to a wheel cap; 405 to a wheel fixing screw; 406 to a hub; 407 and 408 to handles; 409 to a weight mount; 410 through 412 to weights; 413 and 413' to weight locating pins; 414 and 414' to weight locating holes; 415, 415' and 416, 416' to recesses for lifting the weight by fingers; 417 to a clearance hole for the handle 408; 418 through 423 to magnets, respectively.

The beauty treatment device shown in FIG. 22 as the eighth embodiment of this invention is placed on the skin surface being massaged, with the edges of the wheels 402 caused to dent into the skin surface by the weight of the device body 401, the weights 410 through 412. As described in detail with reference to the first and second embodiments of this invention, massaging is effected as the device is caused to travel on the skin surface while the wheels 402 are rotated by the wheel driving mechanism incorporated in the device body 401, as shown in FIGS. 2, 3 and 5. Furthermore, the massaging effect of the device is enhanced by causing the wheel 402 to vibrate by the vibration generating mechanism shown in FIGS. 2, 3 and 5. That is, the eighth embodiment of this invention is adapted to allow the pushing force of the edges of the wheels 402 onto the skin to be adjusted to a desired value by making the weights 410, 411 and 412 detachable from the weight mount 409 and the device body 401. To increase the pushing force, all the weights 410 through 412 are placed on the device. To decrease the pushing force, on the contrary, whole or part of the weights 410 through 412 are removed from the device. The beauty treatment device as the eighth embodiment of this invention has such a construction that the weights can be easily installed on and removed from the device, as will be described later. In addition the eighth embodiment of this invention shown in FIG. 22 is constructed so that the wheels 402 can be easily changed. Since the wheel changing mechanism of the eighth embodiment is essentially the same as that described with reference to the third and fifth embodiments, detailed description of the mechanism has been omitted here. It should be noted that the wheel cap 404, the wheel fixing screw 405, the hub 406, etc. are provided for this purpose.

Now, the weights used in the eighth embodiment of this invention and the operation of installing and removing the same on and from the device will be described, referring to FIG. 23.

In the embodiment shown in FIG. 23, the weight mount 409 for detachably mounting the weights 410 and 411 is provided. On the weight mount 409, provided are the weight locating pins 413 and 413' and the magnet 421. On the weights 410 and 411, provided are the weight locating holes 414 and 414' and the magnet 418 at locations corresponding to the weight locating pins 413 and 413' and the magnet 421, respectively; the polarity of the magnet 418 being adapted so that the magnetic pole thereof facing to the magnet 421 is opposite to that of the magnet 421. That is, the polarity of the magnet 418 provided on the weight 410 is adapted so that the magnetic pole thereof facing to the magnet 421 is the S pole because the upper surface of the magnet 421 is the N pole in the embodiment shown in FIG. 23. On the weight 411, a magnet having the same polarity as that of the magnet 418 provided on the weight 410 is provided, though not shown in the figure. The polarity of the magnets 421 and 418 may be reversed from the state shown in FIG. 23 to the state where the upper surface of the magnet 421 is the S pole and the manetic pole, facing to the magnet 421, of the magnet 418 is the N pole.

When the weights 410 and 411 are placed on the weight mount 409, the weight locating pins 413 and 413' are passed through the weight locating holes 414 and 414'. As a result, the weights 410 and 411 are securely placed in the weight mount 409 by means of the weight locating pins 413 and 413' and the weight locating holes 414 and 414' as well as by means of the magnets 421 and 418. On the weights 410 and 411, the recesses 415 and 415' for lifting the same by fingers are provided for ease of handling.

The weight 412 is used for increasing the pushing force onto the skin surface by placing on the device body 401 and the weights 410 and 411 placed in the weight mount 409. The weight 412 has the clearance hole 417 for the handle 408 when the weight 412 is placed on the device body 401. The magnets 422 and 423 provided on the device body 401 and the magnets 419 and 420 provided on the weight 412 are used for securing the weight 412 on the device body 401; the polarity of the magnets 419, 420, 422 and 423 being determined in the same manner as with that of the magnets 418 and 421. The recesses 416 and 416' are provided on the weight 412 for lifting the weight 412 by fingers.

In the eighth embodiment shown in FIG. 23, only one piece of the weight 412 is placed on the device body 401, and the weights 410 and 411 housed in the weight mount 409 are of the same size. It is needless to say, however, that the weight of the entire device can be changed by increasing the number of the weight 412 or changing the thicknesses of the weights 410 and 411.

As described above, the eighth embodiment of this invention makes it possible to easily change the weights to be placed on the device body, and thereby to adjust the pushing force to a desired level.

Figure 24:
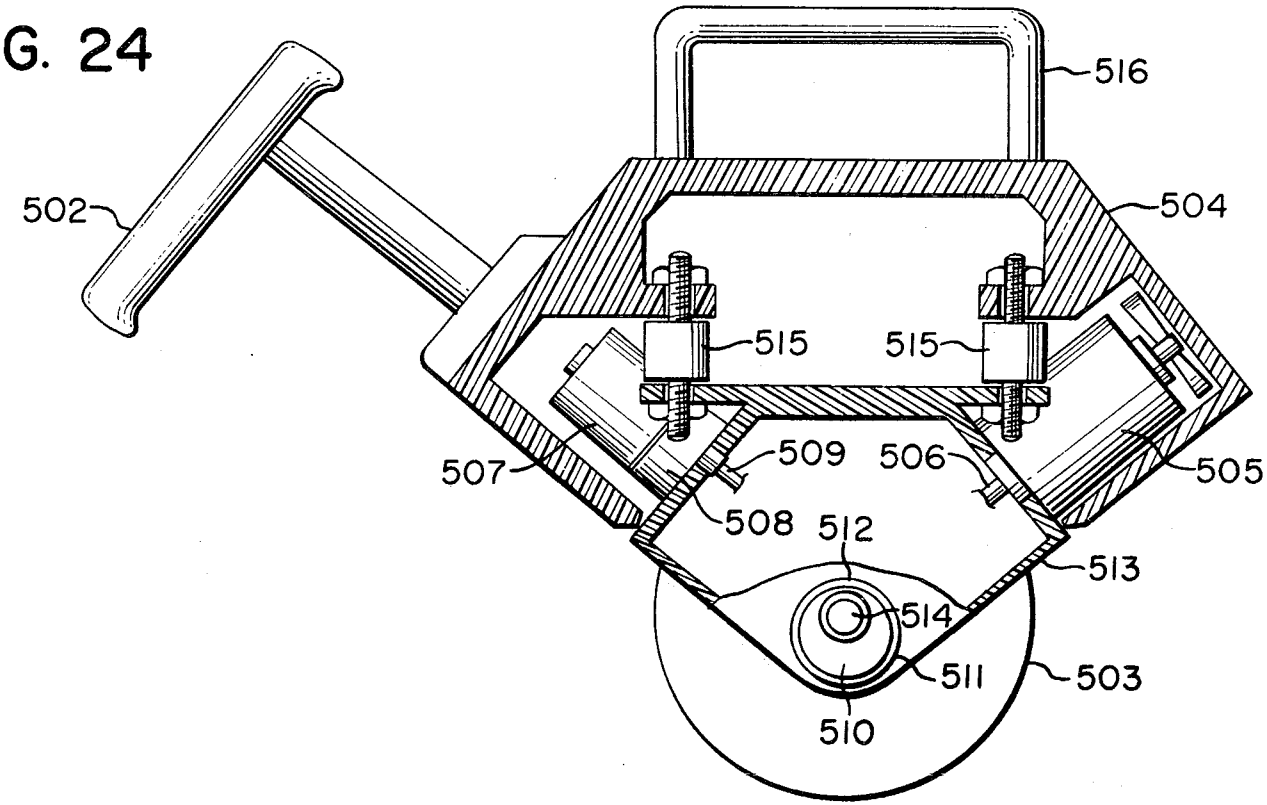
FIG. 24 is a sectional side elevation of a ninth beauty treatment device embodying this invention.
Figure 25:
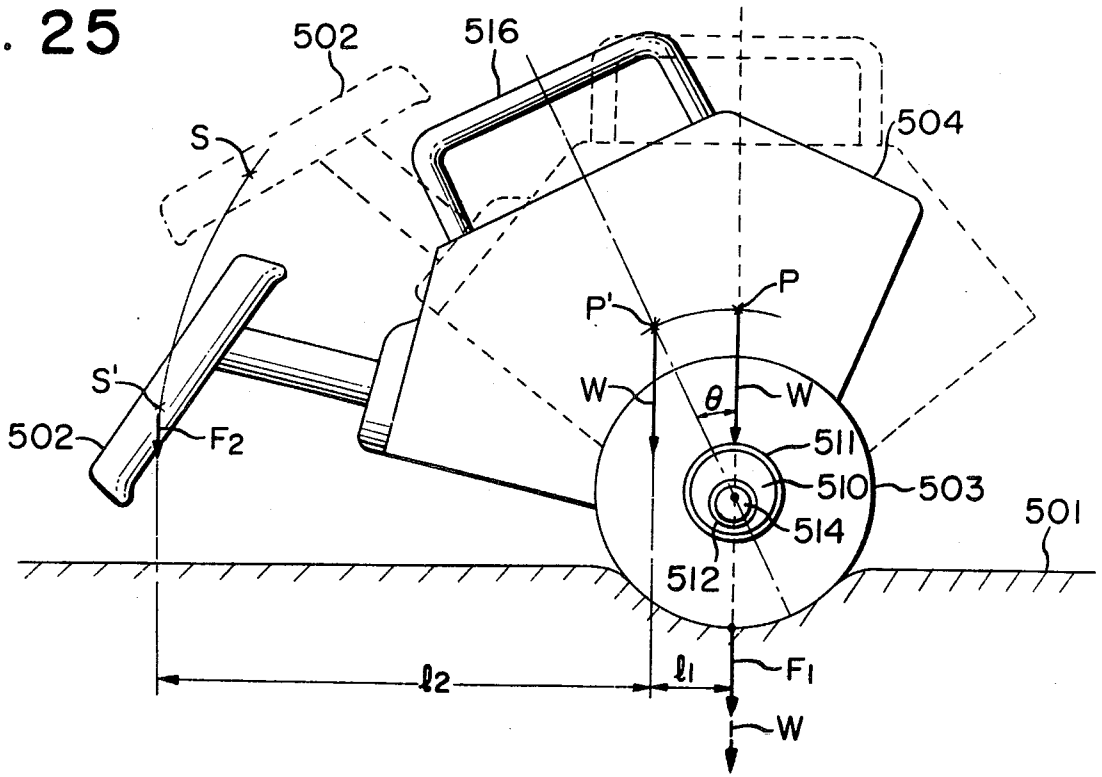
FIG. 25 is a diagram illustrating the method of adjusting pushing force in the ninth embodiment shown in FIG. 24.

Furthermore, FIGS. 24 and 25 show the ninth embodiment of this invention which makes it possible to easily change the pushing force of the wheels onto the skin. In the figures, reference numeral 501 refers to the skin surface; 502 to a handle; 503 to a wheel; 504 to a device body; 505 to a vibration generating motor; 506 to a motor shaft; 507 to a wheel driving motor; 508 to a reduction gear; 509 to an output shaft of the reduction gear 508; 510 to a revolving member with an eccentric shaft hole; 511 and 512 to bearings; 513 to a drive unit; 514 to a wheel drive shaft; 515 to a rubber vibration insulator; 516 to a handle, respectively.

In FIG. 24 illustrating the ninth embodiment of this invention, the revolving member 510 is rotatably supported on a side plate of the drive unit 513 via the bearing 511. The wheel drive shaft 514 is rotatably supported via the bearing 512 in an eccentric shaft hole provided at an off-center position on the revolving member 510, and the wheel 503 is fixed to the wheel drive shaft 510.

The revolving member 510 is caused to rotate by the vibration generating motor 505 via a vibration generating mechanism (not shown) interposed between the motor shaft 506 of the vibration generating motor 505 and the revolving member 510. The wheel drive shaft 514 is caused to rotate by the wheel driving motor 507 via the universal joint and the wheel driving mechanism shown in FIGS. 5 and 8. Consequently, the wheel 503 is caused to revolve on the axis thereof by the wheel drive shaft 514 while making an orbital motion along a predetermined orbit as the revolving member 510 revolves. It is needless to say that the drive unit 513 is mounted on the device body 504 having the handles 516 and 502 via the rubber vibration insulator 515.

Next, the operation of the ninth embodiment of this invention having such a construction will be described, referring to FIG. 24.

When the beauty treatment device representing the ninth embodiment of this invention is placed on the skin surface 501 of a person's back where the brown adipose tissues described in the Prior Art section of this Specification, the wheel 503 presses the skin surface 501 by the weight of the beauty treatment device in such a manner that the sharp edge of the wheel 503 sinks into the skin surface, as shown in FIG. 25. In such a state, the wheel 503 makes an orbital motion along a predetermined circular orbit as the vibration generating motor 505 is rotated, as described in the description of the second embodiment with reference to FIGS. 5 through 9. The orbital motion of the wheel 503 produces vibrations on the skin surface 501 to effect massaging action. On the other hand, the wheel 503 rotates on the axis thereof at a low speed, causing the beauty treatment device to travel on the skin surface 501.

As described in the description of the motor control circuit with reference to FIG. 10, massaging at a desired location or range by alternately reversing the rotation of the wheel driving motor 507 and controlling the direction of travelling of the beauty treatment device by the operator holding the handle 502.

In the foregoing, massaging using the beauty treatment device embodying this invention has been described. As shown in FIGS. 24 and 25, the pushing force of the device onto the skin surface 501 during massaging depends on the weight of the device transmitted to the wheel 503. For example, when the beauty treatment device is in a position shown by dotted lines in FIG. 25, that is in a position where the gravity center P of the beauty treatment device falls on a vertical line drawn through the center of the wheel 503, the whole weight W of the beauty treatment device is applied onto the wheel 503. In other words, when the device is in such a position, the pushing force reaches its masimum, and no force is applied to the supporting point S on the handle 502 held by the operator. In practice, it is unlikely that the handle 502 is supported at only one point, but let us suppose, for the convenience of illustration, that the handle 502 is supported at the point S, as described above.

Now, consider the pushing force exerted by the wheel 503 when the beauty treatment device is tilted at an angle of $\theta$, as shown by solid lines in FIG. 25. In this case, the gravity center of the device is shifted to the point P'. Assuming that the pushing force of the wheel 503 is $F_1$, the force exerted at the supporting point S' on the handle 502 is $F_2$, the horizontal distance between a vertical line drawn through the center of the wheel 503 and a vertical line drawn through the point P' is $l_1$, and the horizontal distance between a vertical line drawn through the point P' and a vertical line drawn through the supporting point S' is $l_2$, the relationship among $F_1$, $F_2$, $l_1$, $l_2$ and the weight W of the device is expressed by the following equations.

$$W = F_1 + F_2 \quad (1)$$

$$F_1 \cdot l_1 = F_2 \cdot l_2 \quad (2)$$

As is evident from the above equations (1) and (2), the larger the tilting angle $\theta$ in FIG. 25 is, the smaller becomes the pushing force $F_1$ of the wheel 503.

The beauty treatment device of this invention makes it possible to control the pushing force onto the skin surface 501 by adopting such a construction that the tilting angle $\theta$ in FIG. 25 can be varied to a great extent, based on the above principle. That is, the beauty treatment device of this invention has such a shape that the vertical distance between the skin surface 501 and the bottom surface of the drive unit 513 and the device body 504, that is the surface of the device facing the skin surface 501 is increased as the bottom surface of the device goes away from the center of the wheel 503. In other words, the device has an inverted triangular shape with an apex falling on the vertical center line of the wheel 503, as shown in FIG. 24. The device may be of an essentially inverted triangular shape with a step-like or arc-shaped bottom surface.

As described above, the aforementioned embodiment makes it possible to provide a beauty treatment device which can massage with a desired pushing force corresponding to the thickness of the muscular tissue being massaged by controlling the pushing force merely by raising or lowering the handle.

As is evident from the above description this invention makes it possible to provide a beauty treatment device which can penetrate a massaging effect into muscular tissues deep beneath the skin surface, whereby removing surplus subcutaneous fat, preventing the skin from lossening through the training of muscular tissues, and improving the circulation of blood, thus resulting in improved health and beauty. This invention also makes it possible to provide a beauty treatment device which can effect massage by giving the optimum stimulus corresponding to the individual characteristics of the person being treated with less effort to the operator.

What is claimed is:

1. A beauty treatment device comprising:

a device body;

at least one vibration gear and means for rotatably mounting said gear to said body, said gear having an eccentrically located shaft hole therethrough;

a wheel shaft rotatably mounted in said shaft hole in said vibration gear for movement in an orbital path with rotation of said vibration gear;

a plurality of sharp-edged disc-like wheels connected to said wheel shaft for rotation and orbital movement with rotation and orbital movement of said wheel shaft, said wheels adapted to be depressed onto a skin surface and adapted to roll on the skin surface with rotation of said wheels;

drive means mounted in said device body and connected to said vibration gear for rotating said vibration gear; and a weight resting on said device body for exerting force on said wheels.

2. A device according to claim 1 wherein said drive means comprise a motor connected to said device body having a motor shaft and a drive gear connected to said motor shaft and meshed with said vibration gear for rotation of said vibration gear with rotation of said motor shaft.

3. A device according to claim 2, including a travel mechanism connected to said device body and having a universal joint connected to said wheel shaft for rotation of said sheel shaft to rotate said wheels, said universal joint permitting rotation of said wheels with movement of said wheel shaft in said orbital path.

4. A device according to claim 3, wherein said travel mechanism comprises a worm box rotatably mounted to said sheel shaft, a worm gear rotatably mounted in said worm box, a worm wheel connected to said wheel shaft and meshed with said worm gear and a motor having a driving connection connected to said worm gear for rotating said worm gear.

5. A device according to claim 1, including a wheel changing mechanism connected between said wheel shaft and each wheel for permitting an interchangeable mounting of each wheel on said wheel shaft.

6. A device according to claim 5, wherein said wheel changing mechanism comprises a hub connected to said wheel shaft for each wheel, each wheel having a hole therein for receiving said hub, said wheel shaft having an end portion with a thread, a wheel cap extending over each hub and over a portion of each respective wheel, and screw means threaded to each thread of said wheel shaft for retaining each wheel cap and wheel on said wheel shaft.

7. A device according to claim 1, wherein said weight is detachably mounted to said device body and includes magnetic means for magnetically attracting said weight to said device body.

8. A device according to claim 1, wherein said device body has a lower triangular shape with a downwardly facing apex, said vibration gear with said wheel shaft extending through said device body at a location near said apex.

9. A beauty treatment device having sharp-edged disc-like wheels, a wheel shaft for supporting the wheels, a device body for rotatably supporting the wheel shaft, a weight resting on the device body, for giving pushing force to the wheel shaft, and characterized in that the sharp edges of the wheels depress the skin surface while the wheels turn around on the skin surface, a vibration generating mechanism for giving vibration to the wheels, the vibration generating mechanism having gears with eccentric shaft hole, bearings for rotatably connecting said gears to the device body, the wheel shaft rotatably supported on said gears by said eccentric shaft hole, and a vibration generating motor which drives the gears with eccentric shaft hole and means for drivingly connecting said motor to said vibration generating mechanism.

10. A beauty treatment device as set forth in claim 9 including a travelling mechanism connected for causing the wheel shaft supporting the wheels to rotate on the axis thereof.

11. A beauty treatment device as set forth in claim 10 wherein the travelling mechanism has such a construction that the rotation of a driving motor installed in the device body is reduced in speed by a drive unit consisting of a reduction gear mechanism and transmitted to the wheel shaft to cause the wheels to travel on the skin surface.

12. A beauty treatment device as set forth in claim 9 wherein the wheel is interchangeably mounted on the wheel shaft by means of a wheel changing mechanism.

13. A beauty treatment device as set forth in claim 12 wherein the wheel changing mechanism comprises a hub fixed to an end of the wheel shaft and a hub insert hole formed on the wheel for receiving the hub and has such a construction that the wheel is detachably fitted to the hub fixed to the wheel shaft end, a wheel cap over the hub interposed, and a wheel fixing screw into a tapped thread provided on the end of the wheel shaft.

14. A beauty treatment device as set forth in claim 13 wherein the wheel changing mechanism has engaging recesses and engaging projections so as to prevent the wheel fitted to the hub from moving in the direction of rotation.

15. A beauty treatment device as set forth in claim 9 wherein the wheel has a tire on an outer periphery thereof.

16. A beauty treatment device as set forth in claim 15 wherein the wheel has an annular recess formed along the outer periphery thereof, and the tire has an annular projection formed along the inner periphery thereof; the annular projection of the tire having an edge of a desired shape being engaged with the annular recess of the wheel.

17. A beauty treatment device as set forth in claim 9 wherein the device body has a weight mount on which the weight is detachably mounted.

18. A beauty treatment device as set forth in claim 17 wherein the weight has magnetic poles of different polarities at opposing positions.

19. A beauty treatment device as set forth in claim 9 wherein the device body bottom surface opposing the skin surface is formed into an essentially inverted triangular shape with the wheel shaft position as an apex so as to permit the device body to be tilted with the wheel shaft of the wheel near a fulcrum.

* * * * *